US005527121A

United States Patent [19]

Santon

[11] Patent Number: 5,527,121

[45] Date of Patent: Jun. 18, 1996

[54] PRINTHEAD CARRIAGE CONTROL METHOD AND APPARATUS FOR ACHIEVING INCREASED PRINTER THROUGHPUT

[75] Inventor: John C. Santon, Johnstown, Colo.

[73] Assignee: Hewlett-Packard Company, Palo Alto, Calif.

[21] Appl. No.: 389,523

[22] Filed: Feb. 15, 1995

[51] Int. Cl.[6] ..... B41J 19/30

[52] U.S. Cl. ..... 400/323; 400/279

[58] Field of Search ..... 400/279, 320, 400/322, 323, 903

[56] References Cited

U.S. PATENT DOCUMENTS

| | | | |
|---|---|---|---|
| 4,079,298 | 3/1978 | Prager | 318/260 |
| 4,324,499 | 4/1982 | Giacone | 400/144.2 |
| 4,332,461 | 6/1982 | Cail et al. | 355/14 R |
| 4,529,281 | 7/1985 | DeRoche et al. | 353/27 A |
| 4,541,334 | 9/1985 | Liedtke et al. | 101/93.18 |
| 4,761,085 | 8/1988 | Angst et al. | 400/322 |
| 4,772,837 | 9/1988 | MacMunn | 318/687 |
| 4,775,087 | 10/1988 | Moser et al. | 101/228 |
| 4,833,626 | 5/1989 | Malcolm | 400/322 |
| 4,869,610 | 9/1989 | Nishizawa et al. | 400/322 |
| 5,189,436 | 2/1993 | Yoshikawa | 400/322 |

*Primary Examiner*—Christopher A. Bennett
*Assistant Examiner*—Steven S. Kelley

[57] ABSTRACT

Optimization of printer throughput is achieved through the use of a printhead carriage control method and a corresponding apparatus which directs acceleration of the printhead carriage based on the length of a future printhead carriage swath. According to the improved method, print data is periodically previewed to determine the length of a future swath, and the carriage is accelerated to an optimal printing velocity which is selected based on the determined swath length. The printer prints at the selected printing velocity, and then decelerates the carriage to complete the pass. During deceleration, the medium is advanced to its next position, and the print data is again previewed in order to determine the swath length for use in selecting the optimal printing velocity for the next carriage pass.

16 Claims, 3 Drawing Sheets

PRINTHEAD CARRIAGE CONTROL METHOD AND APPARATUS FOR ACHIEVING INCREASED PRINTER THROUGHPUT

TECHNICAL FIELD

The present invention relates generally to printer carriage control, and more particularly, to a method and apparatus whereby increased printer throughput may be achieved. The invention arises from recognition of the fact that printer throughput is governed by the entirety of the carriage pass, not just that portion where the printer actually prints.

BACKGROUND ART

In a conventional printer, printing occurs via carriage-mounted printheads which are passed across a sheet at the maximum attainable carriage velocity, generally in an attempt to maximize printer throughput by minimizing actual printing time. Carriage velocity, however, is not without boundary, or without cost. As carriage velocity increases, for example, print quality may decrease due to inherent limitations of the printhead. Also, the maximum attainable carriage velocity is governed by the carriage motor's maximum acceleration rate, and by the distance available for the carriage to accelerate.

Printer manufacturers thus have struggled to increase printer throughput by improving printhead performance, and/or by increasing attainable carriage velocity through more powerful carriage motors or increased distance for the carriage to accelerate. This approach, however, has proven to be expensive, and has sometimes required an unnecessary compromise in printer size. Further, the cited approach has failed to recognize that printer throughput is related not only to the actual printing time, but also to the carriage's acceleration and deceleration times. It will be appreciated, for example, that as the carriage's printing velocity increases, so does the amount of time it takes to accelerate and decelerate. At shorter swath lengths (the distance between an initial printing location and an initial deceleration location of the carriage), the delay due to increases in acceleration and deceleration times may, in fact, exceed any benefit from an increase in printing velocity. What is needed is a printhead carriage control approach which increases a printer's throughput by optimizing carriage velocity through a consideration of the entire carriage pass.

DISCLOSURE OF THE INVENTION

The aforementioned problems are addressed through the use of a carriage control method whereby the printhead carriage's printing velocity is optimized in view of the length of a corresponding swath. According to this method, print data is periodically previewed in order to determine the length of the next swath, and the carriage is accelerated to a printing velocity which is selected based on such determined swath length. The printer prints the previewed swath at the selected velocity, and then decelerates the carriage to a stop so as to complete the pass. During deceleration, the medium is advanced to its next position, and the print data is again previewed so as to determine the length of the next subsequent swath for use in selecting an optimal velocity characteristics for the following carriage pass. Increased printer throughput thus is achieved by making the printer smarter without increasing the carriage motor's torque or the printer's footprint, all at the much lower cost of modifying controller firmware or code.

The apparatus of the invention similarly may be summarized as an improvement whereby the printer's controller is made capable of previewing print data for use in optimizing the printhead carriage's velocity characteristic. The controller thus is configured to determine the length of each swath, and direct the carriage motor to accelerate the carriage for a variable duration of time which is selected based on the determined swath length. Acceleration periods of successive passes of the printhead carriage thus may vary in accordance with the length of each corresponding swath so as to optimize carriage velocity, and thereby to increase printer throughput.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
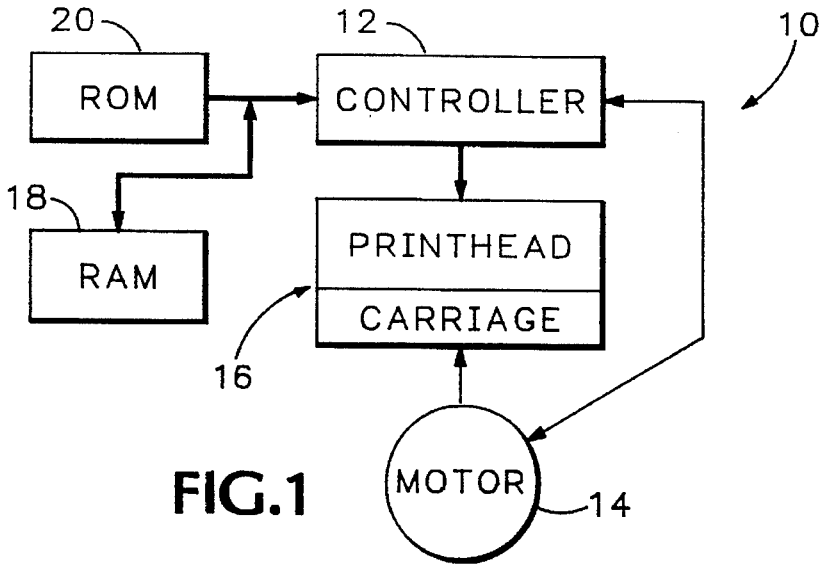
FIG. 1 is a schematic block diagram of an apparatus constructed in accordance with a preferred embodiment of the invention.

Referring initially to FIG. 1, a preferred embodiment of the invented printhead carriage control apparatus is shown in schematic block diagram form, such apparatus being indicated generally at 10. Apparatus 10, it will be noted, preferably includes a controller 12 (e.g., a microprocessor and associated control circuitry); a carriage motor 14; a printhead carriage 16 (reciprocated by the carriage motor); a print data buffer (e.g., a read-and-write memory (RAM) device 18); and a code or firmware parameter store (e.g., a read-only memory (ROM) device 20). These components are implemented in a printer, preferably in the form of a somewhat typical desktop printer such as an ink-jet printer of the type well known in the art.

As indicated, controller 12 is coupled with motor 14, printhead carriage 16, and the printer's memory (RAM 18 and ROM 20), the controller thus being made capable of previewing print data which is stored in RAM, and of executing instructions which are stored in ROM. The printer's motor, for example, may be directed to pass the printhead carriage across a sheet of print medium, the onboard printhead depositing ink on the sheet so as to print a printable image from RAM 18. The velocity (speed and direction) of the carriage also is controlled by the printer's controller, generally in view of the print data as it relates to predefined selection criteria stored in ROM 20. The sheet is advanced line-by-line, also typically by controller 12, via a feed mechanism which may be driven by the carriage motor (or by a different motor) and a suitable drive train.

Typically, carriage motor 14 has a predetermined, relatively low torque and capacity, but is capable of directing the printhead carriage 16 to accelerate, slew (move at constant velocity) and decelerate between nominal stops defined by the print data and by the printer's physical configuration (including a desirably small footprint). Controller 12 thus produces carriage control signals (e.g., stepper pulses) that command carriage motor 14 controllably to advance the printhead carriage in either direction so as to move the carriage across the medium through reciprocating printhead carriage passes. Feed control signals (e.g., stepper pulses), similarly are produced by the controller to command sheet advancement, preferably at or near the end of each carriage pass. The controller also produces printable data signals which represent pixel images to be deposited on the print medium by ink-jets within the printhead.

In accordance with the invention, controller 12 is capable of previewing the print data in RAM 18 in order to determine the length of the next printhead swath. The determined swath length then is used in selecting an optimal velocity characteristic for the corresponding printhead carriage pass. Selection is made by the controller using predetermined selection criteria which are stored in ROM 20. Such criteria preferably are based on empirical data, but may be based on mathematically determined data as will be described below.

In the present embodiment, selection criteria are chosen based on calculated carriage pass durations for a number of model carriage passes, each having a different velocity characteristic. Calculations are performed assuming known acceleration and deceleration rates, and assuming a known swath length. By comparing model carriage pass durations, it thus is possible to intelligently select a velocity characteristic which minimizes the duration of a printhead carriage pass. Controller 12 then begins a carriage pass by producing carriage control signals which cause the printhead carriage to accelerate to an optimal printing velocity in accordance with a selected acceleration profile. The controller next causes the carriage to slew across the sheet at the optimal printing velocity, and directs the printhead to print a printable image. Upon completing the swath, the controller produces carriage control signals which cause the carriage to decelerate to a stop in accordance with a selected deceleration profile, thus ending the carriage pass.

As suggested earlier, carriage acceleration may be directed in accordance with any one of a number of different acceleration profiles, such profiles representing the acceleration of the printhead carriage from a stop to an optimal printing velocity for the particular pass. An acceleration profile may be characterized by a constant acceleration rate (perhaps equal to the maximum acceleration rate of the carriage motor), or may be characterized by an "initial" acceleration rate followed by a lesser "corner" acceleration rate so as to provide for a smoother transition between an increasing carriage velocity and an optimal printing velocity at which the carriage slews. The acceleration profiles are stored in the printer's memory such as ROM 20, and are selected using selection criteria which look to the length of a corresponding carriage swath. Accordingly, it will be appreciated that a printhead carriage may be accelerated to a selected optimal printing velocity which corresponds to a predetermined duration of time substantially based on a determined future swath length.

Deceleration similarly may be directed in accordance with any one of a number of different deceleration profiles stored in memory such as ROM 20, where different deceleration profiles accommodate more or less rigorous braking and attendant taxing of carriage motor 14. This advantageously may extend the life of carriage motor 14 by reducing torque thereon to a selected torque and acceleration capacity versus life expectancy rating.

During carriage deceleration, the controller previews the print data to determine the length of the next swath, and thus to select the optimal corresponding printing velocity for the next carriage pass. Optimal printing velocity, it will be recalled, is related to the length of the swath. Because controller 12 previews printable data for future carriage passes during deceleration, any processing delay is masked by the carriage deceleration time. The controller also begins advancement of the sheet during carriage deceleration, preferably so as to complete sheet advancement before the carriage stops, saving additional time. Still more time may be saved by performing other controller operations during carriage deceleration. Thus, higher carriage motor speeds may be attained without exceeding the nominal predetermined acceleration capacity of carriage motor 14, and without increasing the printer's footprint.

Apparatus 10 is compatible with bi-directional printing, providing a context whereby another advantage of the invention may be understood. As previously indicated, toward the end of a given carriage pass, controller 12 will already be previewing the print data within RAM 18 for use in determining the length of a return swath. Persons skilled in the art will appreciate, however, that such determination requires only negligible time relative to the time required to decelerate the carriage from a suitably high printing velocity. Controller 12 thus will have already selected the acceleration profile, optimal printing velocity, and deceleration profile of the printhead carriage for the next carriage pass when the carriage reaches the end of the current pass.

To determine swath length, it is necessary to preview the image length (the length of the to-be-printed image) of two carriage passes. Controller 12 thus may cause carriage motor 14 to begin deceleration at a time which would place the carriage at an appropriate beginning point for the future carriage pass, thereby decreasing the time required to set up for each carriage pass.

Figure 2:
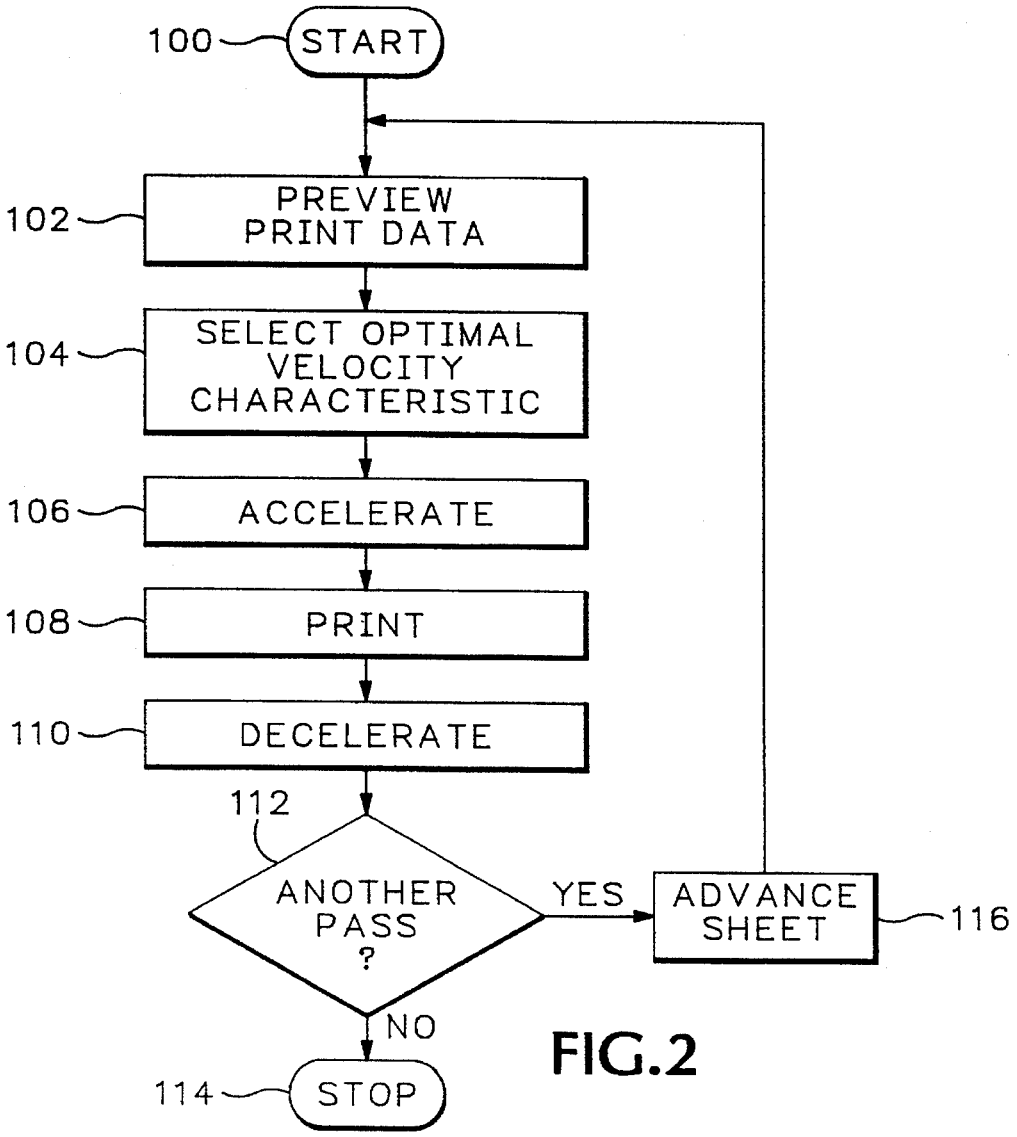
FIG. 2 is a flowchart illustrating the preferred method of the invention.

Turning now to FIG. 2, the preferred method of the invention is described by a flowchart, such flowchart disclosing sheet processing starting at 100 which includes the steps of: previewing the print data to determine the length of a future swath, as indicated generally at 102; selecting an optimal velocity characteristic of the printhead carriage based on the determined swath length, as indicated generally at 104; accelerating the printhead carriage in accordance with the selected optimal velocity characteristic, as indicated generally at 106; printing a printable image in accordance with the selected optimal velocity characteristic (at an optimal carriage velocity), as indicated generally at 108; and decelerating the carriage to a stop in accordance with the selected optimal velocity characteristic, as indicated generally at 110. At 112, it is determined whether another pass is desired, and if so, the print data is again previewed and the sheet is advanced for execution of another pass. If no other pass is desired, processing stops, as indicated generally at 114.

The invented method will be understood to permit carriage motor 14 to direct variable carriage velocity characteristics, and thereby to direct variable optimal printing velocities, without any required increase in acceleration rate. The result is a variable, artificially intelligent control of the carriage velocity characteristic enabling higher printer throughput on print tasks, particularly wherein the printable image employs narrower carriage passes.

The invented method may be seen to represent a significant improvement over known methods for controlling a printhead carriage in a printer having data stored in its memory. Such methods are characterized as including the steps of accelerating the carriage at a set acceleration rate for a set period of time between a nominal stop location and a first virtual image border location, printing the printable image at a set carriage velocity, and then decelerating the carriage at a set deceleration rate for a set period of time between a second virtual image border location and another nominal stop location. The improvement may be understood to include previewing print data before each pass of the printhead carriage effectively to select an optimal velocity characteristic including an acceleration profile, an optimal printing velocity, and an optimal deceleration profile. Preferably, such previewing, selecting, accelerating, printing and decelerating steps are repeated for each successive pass of the printhead carriage. The optimal velocity characteristic thus will vary in accordance with the length of each swath, as indicated by the directed flow control paths between the "another pass?" decision block 112 and the "preview print data" decision block 102 (FIG. 2).

The previewing step 102 will be understood by those of skill in the art effectively to determine a swath length, whether or not such a determination is explicitly made. In other words, it is within the spirit and scope of the invention for controller 12 simply to read a length embedded in the data, to count a number of character spaces, or to subtract a first from a second address to obtain a swath length measurement. Thus, character counts, distance measurements or derivations thereof, or therefrom, all are contemplated by the invention, with or without any determination of actual length. Also, it is important to note the distinction between swath length (which measures the distance between an initial printing location and an initial deceleration location of the carriage) and pass length (which measures the distance the carriage travels during the entire carriage pass). It is the length of the swath, not the pass, which is used in selecting an optimal velocity characteristic of the pass.

While it is preferable to buffer print data of at least one pass of the carriage in RAM 18, print data of two or more passes may be useful in previewing the print data. What is needed is the ability of the controller to determine the length of the next swath. This would be possible by buffering only a volume of print data that effectively gives a measure of the distance the carriage will travel during the next swath. This generally requires a preliminary determination of the image lengths of both the next pass and the pass subsequent to that. It will be recalled that, when the image lengths of passes change from one to another, it may be desirable to pass the carriage beyond the location which would otherwise be required so as to save on acceleration and deceleration delay.

Once the swath length is determined, an optimal velocity characteristic is selected 104, such characteristic being chosen based on predefined selection criteria, including criteria related to swath length. The controller thus selects an optimal acceleration profile an optimal printing velocity, and an optimal deceleration profile.

After previewing the print data, and selecting an optimal velocity characteristic, the carriage is accelerated as indicated at 106 in FIG. 2. As mentioned earlier, it will be understood that the carriage may be accelerated to its optimal printing velocity at the carriage motor's maximum acceleration rate so as to maximize printer throughput. Preferably, however, the carriage is accelerated initially at the maximum acceleration rate and subsequently at a lesser corner acceleration rate. The accelerating step thus is performed in accordance with a selected optimal acceleration profile which allows for a smoother transition of the carriage from an acceleration movement to a constant velocity slew. This, very straightforwardly, may be accomplished by programming the microprocessor of the controller to select an acceleration profile based on the determined swath length.

Upon reaching a minimal printing velocity the printhead begins printing 108, such event generally occurring while still accelerating the carriage. Upon reaching a selected optimal velocity, the carriage slews across the sheet at such velocity. It is noted that the optimal printing velocity should not exceed printer capacity in order to protect the carriage motor, to preserve print quality, and to preserve the integrity of the communication of data from the controller to the printhead.

The deceleration step 110 next is performed in accordance with a selected deceleration profile, the carriage preferably decelerating at a maximum deceleration rate equal to the maximum acceleration rate. During carriage deceleration, a controller surveys the print data to determine whether another pass will be performed. If another pass is to be performed, the controller begins sheet advancement, and begins a preview of the next swath length. In the preferred embodiment, such sheet advancement and length preview are accomplished prior to completion of carriage deceleration, thereby masking any delay which otherwise would be caused thereby. It is understood, however, that such advancement and/or preview may not be possible in all situations, and that the sheet advancement step may overlap the acceleration step. The preview and selecting steps, however, should be completed prior to initiation of the acceleration step.

Each carriage pass thus will be understood to include an acceleration step (preferably including an initial acceleration period and a corner acceleration period) wherein the carriage is accelerated to printing velocity, a printing step during which the printhead prints, and a deceleration step wherein the printhead is decelerated to a stop. During the initial acceleration period, the carriage preferably is accelerated at a predetermined initial maximum acceleration rate ($A_{max}$). Upon reaching a predetermined minimum printing velocity ($V_{min}$), the printhead begins printing the printable image, and the carriage acceleration rate decreases, preferably to a predetermined corner acceleration rate ($A_{min}$). Upon reaching a predetermined optimal printing velocity ($V_{max}$), carriage acceleration stops, and the carriage is slewed through the rest of the printing swath at optimal printing velocity ($V_{max}$). After printing is completed, the carriage begins deceleration, preferably at a predetermined maximum deceleration rate ($A_{decel}$).

As previously indicated, printhead throughput is determined by the time spent reciprocating the printhead carriage through consecutive carriage passes, each such pass adding to the time required to complete printing of the present sheet. Printer throughput thus is related, not only to the actual printing time, but also to the carriage's acceleration and deceleration times. The total duration ($T_{tot}$) of a printhead carriage pass therefore may be considered to be the sum of the time required for acceleration, printing, and deceleration. For selected values of ($V_{max}$), ($V_{min}$), ($A_{max}$), ($A_{min}$), ($A_{decel}$), and ($L_{swath}$) (where ($L_{swath}$) is the length of the swath), the duration of a carriage pass may be expressed as:

$$T_{tot} = \frac{V_{min}}{A_{max}} +$$

-continued $$\frac{V_{max}-V_{min}}{A_{min}}+\frac{L_{swath}-\frac{(V_{max}-V_{min})^2}{2A_{min}}}{V_{max}}+\frac{V_{max}}{A_{decel}}$$

The first two quotients represent the time spent accelerating the carriage to maximum (optimal) printing velocity. The third quotient represents the time spent printing with the carriage moving at optimal printing velocity. The final quotient represents the time spent decelerating to a stop.

Considering this mathematical representation of pass duration, it is possible to provide a model which illustrates both the manner in which selection criteria are chosen, and the variation in optimal printing velocity with changes in swath length. This is particularly apparent in view of the limitations associated with most conventional carriage motors. Assuming, for example, a printer with a carriage motor having a maximum acceleration rate ($A_{max}$) of 1.25 G (480 IN/S$^2$) and a maximum deceleration rate ($A_{decel}$) equal to ($A_{max}$), and selecting an acceleration profile with a corner acceleration rate ($A_{min}$) equal to ($A_{max}/3$), it is possible to compare the minimum attainable pass durations ($T_{tot}$) for various $V_{max}$, $V_{min}$ pairs. The following table (Table 1) illustrates such a comparison:

TABLE 1

| Printing Velocity (IN/S) | | Duration of Pass (ms) Swath Length | | | | | | |
|---|---|---|---|---|---|---|---|---|
| Vmin | Vmax | 1" | 2" | 3" | 4" | 5" | 6" | 7" |
| 30 | 35 | 193 | 222 | 250 | 279 | 308 | 336 | 365 |
| 24 | 27 | 161 | 198 | 235 | 272 | 309 | 346 | 383 |
| 12 | 13 | 135 | 212 | 289 | 365 | 442 | 519 | 596 |

As will be noted from Table 1, a carriage pass for a 1-inch swath is shorter where the printing velocity ($V_{max}$) is 13 IN/S ($T_{tot}$=135 ms), than it is where the maximum printing velocity ($V_{max}$) is 35 IN/S ($T_{tot}$=193 ms). Oppositely, a carriage pass with a 6-inch swath is longer where the printing velocity ($V_{max}$) is 13 IN/S ($T_{tot}$=519 ms), than it is where the maximum printing velocity ($V_{max}$) is 35 IN/S ($T_{tot}$=365 ms). This comparison also is illustrated graphically in FIGS. 3A and 3B.

Upon reviewing the entirety of Table 1, it will be appreciated that optimal printing velocity relates to swath length, and particularly that optimal printing velocity is: 13 IN/S where $L_{swath}$<2-inches; 27 IN/S where 2-inches <$L_{swath}$<5-inches; and 35 IN/S where $L_{swath}$>5-inches. Those skilled will understand that this may serve as selection criteria for a particular printer configuration.

Figure 3A:
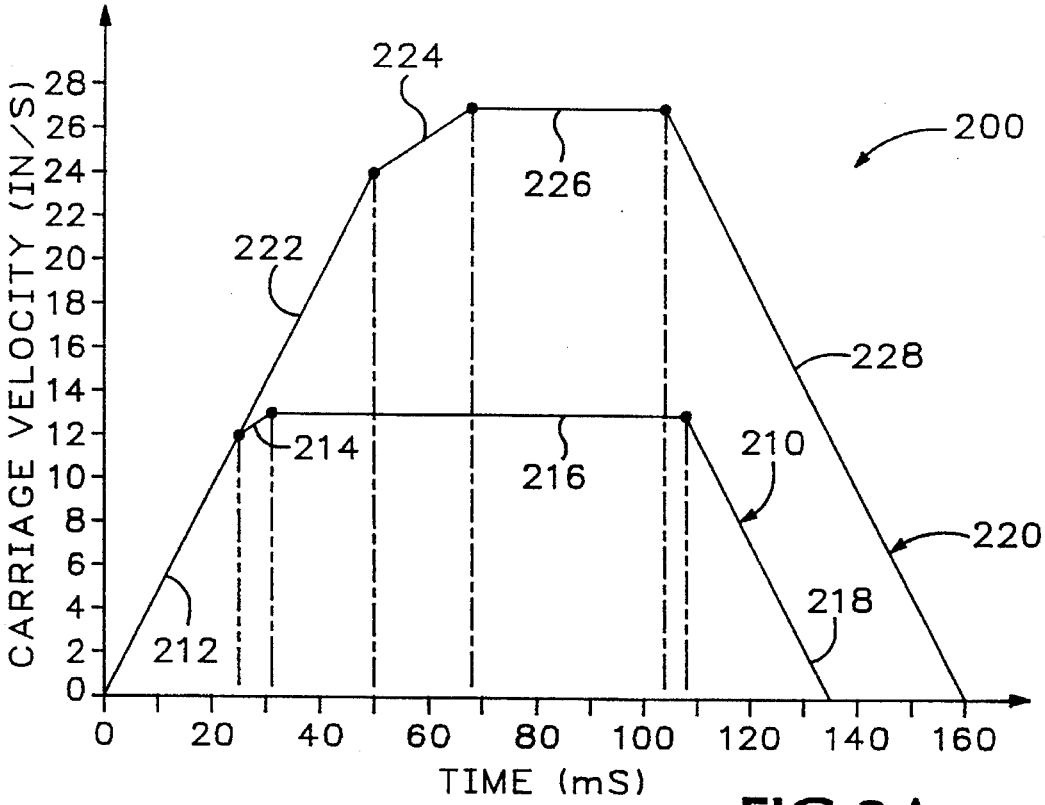
FIGS. 3A and 3B are graphs showing the benefits of selecting carriage velocity based on the length of a future swath.
Figure 3B:
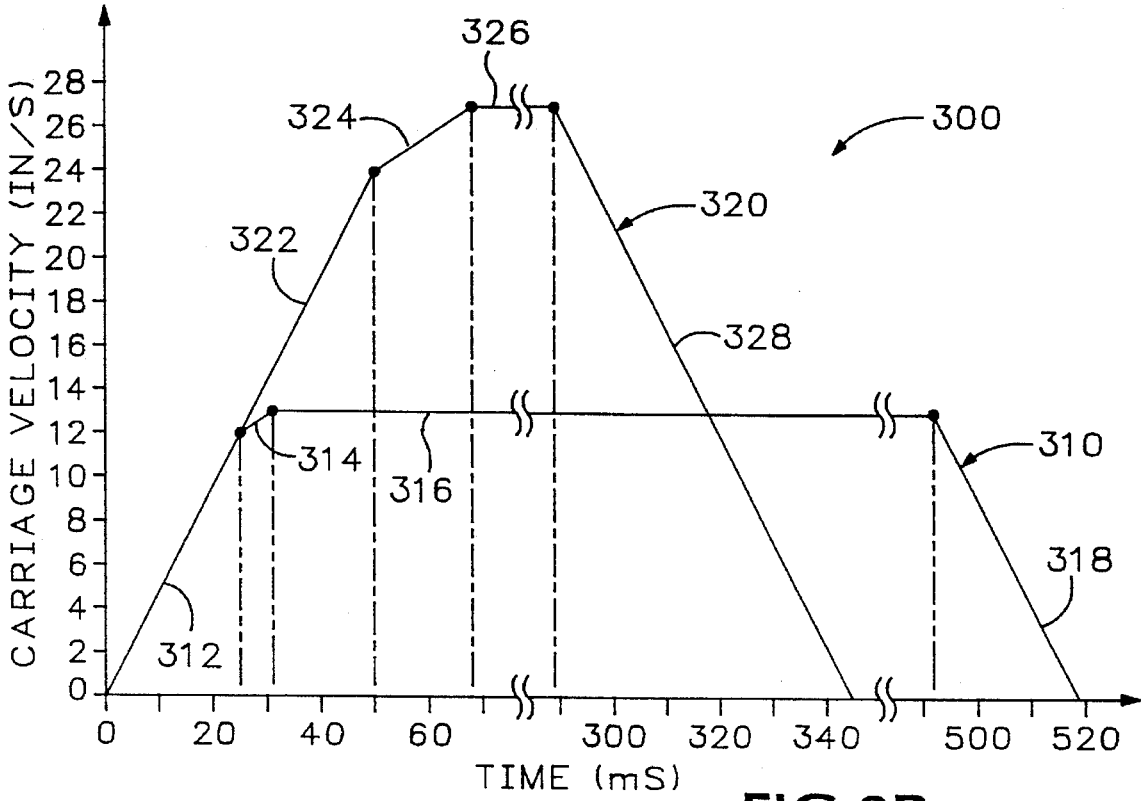

Referring now in detail to FIGS. 3A and 3B, one of the aforementioned advantages of the invented method and apparatus over prior art solutions is further illustrated, FIG. 3A depicting a graph 200 which shows velocity characteristics for a pair of carriage passes 210, 220 with 1-inch swaths, and FIG. 3B depicting a graph 300 which shows velocity characteristics for a pair of carriage passes 310, 320 with 6-inch swaths. The vertical axis of each graph measures printhead carriage velocity (inches/second). The horizontal axes measure elapsed time (milliseconds). Each graph thus maps acceleration, printing, and deceleration of a printhead carriage in accordance with two different velocity characteristics.

In FIG. 3A, it will be noted that carriage pass 210 begins movement from a stop, accelerating through an acceleration step which includes an initial maximum acceleration period 212 and a subsequent corner acceleration period 214. Upon reaching a printing velocity of 13 IN/S, acceleration ceases and the carriage is moved through a printing step 216 (which may begin during corner acceleration period 214). The swath takes approximately 83 ms to complete. Upon completing printing, the carriage continues at the printing velocity, until such time as the carriage reaches a predetermined deceleration starting point (selected based on the image length of the next subsequent pass). The carriage then decelerates at maximum deceleration through the deceleration step 218, concluding the pass upon stopping of the carriage after 136 ms.

Carriage pass 220 similarly reflects passage of the carriage through an acceleration step 222, 224, a printing step 226, and a deceleration step 228, but accelerates the carriage up to a printing velocity of 27 IN/S. The swath thus is completed in only 55 ms. Due to the increased duration of the acceleration and deceleration steps, however, the entire carriage pass takes 160 ms. The slower printing velocity thus will be understood to be preferred for printing a 1-inch swath.

In FIG. 3B, a carriage pass 310 is shown with an acceleration profile, printing velocity, and deceleration profile similar to carriage pass 210, but with a swath length of 6-inches. Pass 310 reflects passage of the carriage through an acceleration step 312, 314, a printing step 316, and a deceleration step 318. The swath is completed in 467 ms. The entire carriage pass is completed in 519 ms.

Carriage pass 320 in FIG. 3B is shown with an acceleration profile, printing velocity, and deceleration profile similar to that of carriage pass 220, but again with a swath length of 6-inches. Pass 320 reflects passage of the carriage through an acceleration step 322, 324, a printing step 326, and a deceleration step 28, but the swath takes only 240 ms to complete. The entire carriage pass is completed in 346 ms, nearly 180 ms less than carriage pass 310. The faster printing velocity thus will be understood to be preferred for printing a 6-inch swath.

Figure 4A:
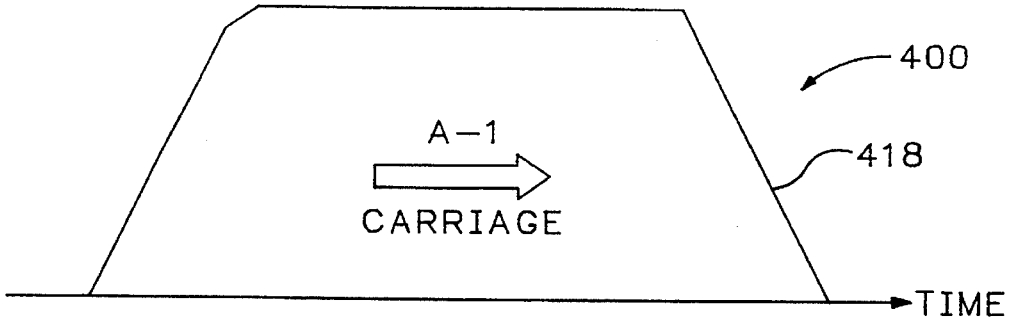
FIGS. 4A through 4D are simplified graphs showing bi-directional carriage movement through four successive carriage passes.
Figure 4B:
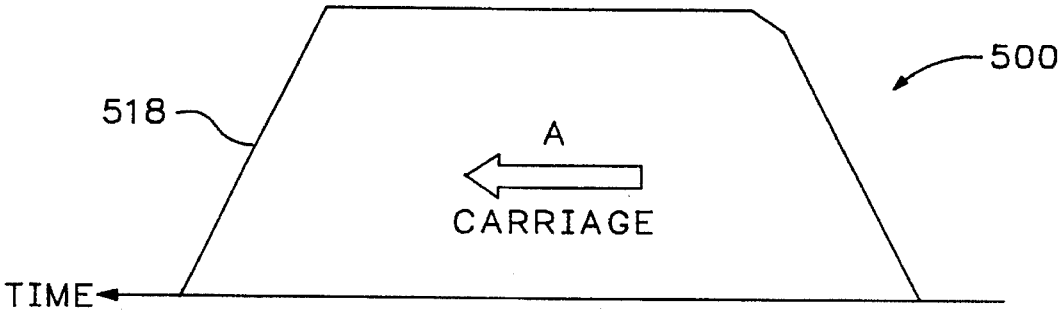
Figure 4C:
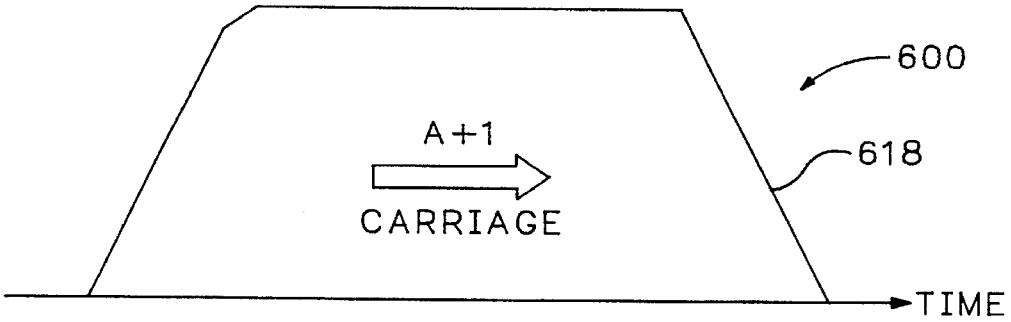
Figure 4D:
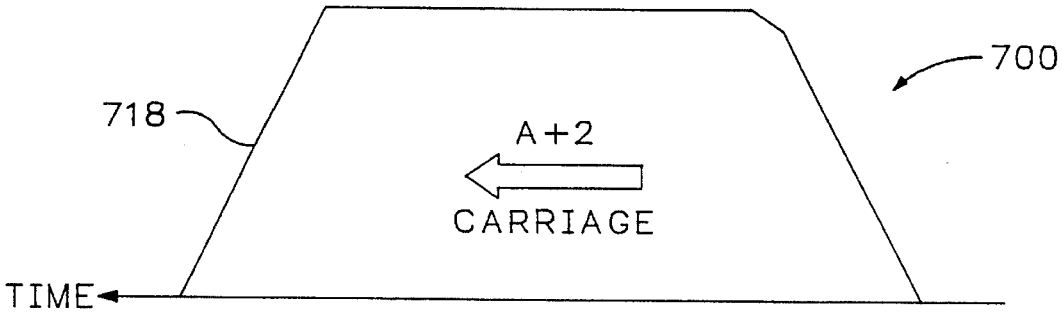

FIGS. 4A through 4D illustrate operation of the invention during four successive carriage passes, each successive pass moving the carriage in a direction opposite to the direction of the next-preceding pass. In FIG. 4A, the carriage is moved left-to-right through a carriage pass 400 which includes swath A−1, the passage of time being shown in the same direction as carriage movement. During a deceleration step 418, the print data contained in the printer's memory is previewed, allowing the controller to determine the length of swath A of the next pass 500 (FIG. 4B) and swath A+1 of subsequent pass 600 (FIG. 4C). With this information, the controller is able to determine the swath length, and select an optimal velocity characteristic of pass 500.

Successive passes of the carriage behave similarly. FIG. 4B, for example, shows the carriage moving right-to-left through a carriage pass 500 which includes swath A, the passage of time being shown in the opposite direction to that of FIG. 4A (i.e., the same direction as carriage movement). During a deceleration step 518, the print data contained in the printer's memory is again previewed, allowing the controller to determine the length of swath A+1 of the pass 600 and swath A+2 of a further subsequent pass 700. With this information, the controller is able to determine the swath length, and select an optimal velocity characteristic of pass 600. Similar preview steps are performed during deceleration step 618 of pass 600 and deceleration step 718 of pass 700.

INDUSTRIAL APPLICABILITY

It may be seen than that the invented method and apparatus greatly increase carriage printer throughput, with negligible incremental cost, by intelligently varying the printing velocity of the printer's carriage based on a determined swath length. The printer's controller need only preview successive print data and utilize the information contained within such data to determine the swath length. The invented method and apparatus are compatible with present printer technologies, including carriage motor torque and acceleration constraints and printer housing configuration (e.g., footprint, constraints). Such variable speed control readily may be imported into existing printer installations by adding artificial intelligence in the form of code or firmware to an existing printer controller's microcode.

While the present invention has been shown and described with reference to the foregoing operational principles and preferred embodiment, it will be apparent to those skilled in the art that other changes in form and detail may be made therein without departing from the spirit and scope of the invention as defined in the appended claims.

I claim:

1. An improved printhead carriage control method for use in a bidirectional printer having print data stored in memory, wherein the method includes the steps of accelerating the printhead carriage, printing a printable image, and decelerating the printhead carriage to define successive carriage passes, the improvement comprising the step of:

previewing the print data to identify image lengths of the next two carriage passes, determining a next swath length based on both of the identified image lengths, and selecting a velocity characteristic of the printhead carriage which is chosen based on the next swath length.

2. The improvement of claim 3, wherein each previewing step at least partly overlaps a corresponding earlier decelerating step.

3. The improvement of claim 2 which further comprises, after each printing step, advancing the sheet medium, each successive advancing step at least partly overlapping the corresponding earlier decelerating step.

4. In a printer having a printhead carriage reciprocable by a motor having a given acceleration capacity, the improvement comprising:

a controller operatively connected to the motor to control the acceleration of the motor, said controller being capable of previewing print data for each carriage pass to identify image lengths of the next two carriage passes for use in determining a corresponding next swath length, said controller causing the motor to accelerate the printhead carriage for a duration of time substantially based on the determined next swath length and printing such print data at a predetermined optimal velocity which corresponds to the duration of time the motor is accelerated.

5. The improvement of claim 4 which further comprises printer memory including predetermined optimal acceleration durations corresponding to various swath lengths, said controller directing acceleration of the printhead carriage in accordance with the determined next swath length.

6. An automatic printhead carriage control method for use in a printer having print data stored in memory, the method comprising the steps of:

previewing the print data to identify the image lengths of the next two carriage passes;

determining the length of a next swath of the printhead carriage based on the image lengths of the next two carriage passes;

selecting an optimal printing velocity of the printhead carriage based on the determined next swath length;

accelerating the printhead carriage to the selected optimal printing velocity of the printhead carriage;

printing at the selected optimal printing velocity of the printhead carriage; and decelerating the printhead carriage.

7. The method of claim 6, wherein said accelerating step involves accelerating the printhead carriage in accordance with a predetermined acceleration profile.

8. The method of claim 6, wherein said accelerating step includes initially accelerating the printhead carriage at a predetermined initial acceleration rate, and then decreasing such acceleration rate of the printhead carriage to a predetermined lesser corner acceleration rate.

9. The method of claim 8, wherein printing begins upon decreasing acceleration to the predetermined lesser corner acceleration rate.

10. The method of claim 6, wherein said decelerating step involves decelerating the printhead carriage in accordance with a predetermined deceleration profile.

11. The method of claim 6 which further comprises, after beginning said decelerating step, repeating said previewing, determining, selecting, accelerating, printing and decelerating steps for successive passes of the printhead carriage.

12. The method of claim 11, wherein each successive previewing step at least partly overlaps a corresponding earlier decelerating step.

13. The method of claim 11 which further comprises, after each printing step, advancing the medium.

14. The method of claim 13, wherein each successive advancing step at least partly overlaps a corresponding earlier decelerating step.

15. The method of claim 11, wherein each determining step includes identifying a nominal printhead carriage start location of a future pass, the next-previous decelerating step concluding with the printhead carriage substantially thereat.

16. The method of claim 11, wherein each determining step includes identifying a last data location, the corresponding decelerating step beginning with the printhead carriage substantially thereat.

* * * * *